US006992663B2

(12) United States Patent
Nakamura et al.

(10) Patent No.: US 6,992,663 B2
(45) Date of Patent: Jan. 31, 2006

(54) DRIVING CIRCUIT OF ACTIVE MATRIX TYPE LIGHT-EMITTING ELEMENT

(75) Inventors: Hiroyuki Nakamura, Atsugi (JP); Shigeki Kondo, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 10/247,626

(22) Filed: Sep. 20, 2002

(65) Prior Publication Data

US 2003/0016191 A1 Jan. 23, 2003

Related U.S. Application Data

(63) Continuation of application No. PCT/JP02/02593, filed on Mar. 19, 2002.

(30) Foreign Application Priority Data

Mar. 22, 2001 (JP) ..... 2001-081880

(51) Int. Cl.
*G09G 3/30* (2006.01)

(52) U.S. Cl. ..... 345/204; 345/55; 345/76; 345/77; 345/82; 345/92; 345/214; 313/500; 313/504; 313/505; 315/169.1; 315/169.3; 362/800

(58) Field of Classification Search ..... 345/55, 345/76, 77, 82, 92, 204, 214; 313/500, 504, 313/505; 315/169.1, 169.3; 362/800
See application file for complete search history.

(56) References Cited

U.S. PATENT DOCUMENTS 3,921,035 A * 11/1975 Holmes ..... 315/307
5,006,732 A 4/1991 Nakamura et al. ..... 307/473
5,091,722 A * 2/1992 Kitajima et al. ..... 345/89
5,640,067 A * 6/1997 Yamauchi et al. ..... 313/504
6,037,718 A * 3/2000 Nagami ..... 315/169.3
6,091,203 A * 7/2000 Kawashima et al. ..... 315/169.3
6,204,610 B1 * 3/2001 Komiya ..... 315/169.3
2001/0019327 A1 * 9/2001 Kim et al. ..... 345/204

FOREIGN PATENT DOCUMENTS

| | | |
|---|---|---|
| EP | 0 895 219 A1 | 2/1999 |
| EP | 0 917 127 A1 | 5/1999 |
| EP | 1 130 565 A1 | 9/2001 |
| JP | 63-77172 | 4/1988 |
| JP | 3-180079 | 8/1991 |
| JP | 8-54835 | 2/1996 |
| WO | WO 98/36407 | 8/1998 |
| WO | WO 01/06484 A1 | 1/2001 |

OTHER PUBLICATIONS

Light-emitting diode drive circuit; European Patent Application 0 441 965 A1; Inventor: Yagi, K et al.; Pub. Date Jan. 10, 1991.*

"Low-Temperature Poly-Si TFT Display using Light-Emitting-Polymer," M. Kimura, et al., AM-LCD 2000, AM3-1, pp. 245-248, 2000.

* cited by examiner

*Primary Examiner*—Ricardo Osorio
*Assistant Examiner*—Vincent E. Kovalick
(74) *Attorney, Agent, or Firm*—Fitzpatrick, Cella, Harper & Scinto

(57) ABSTRACT

Gradation is improved in image formation by image-forming apparatus employing a light emitting elements such as organic light-emitting element, and image quality. A light-emitting element is provided in which the emission and no emission of light is controlled by the intensity of the input signal from the scanning line and the signal line by flowing constant electric current to a two-input-differential connection circuit one of which is connected to the light-emitting element.

15 Claims, 5 Drawing Sheets

DRIVING CIRCUIT OF ACTIVE MATRIX TYPE LIGHT-EMITTING ELEMENT

This application is a continuation of International Application No. PCT/JP02/02593, filed Mar. 19, 2002, which claims the benefit of Japanese Patent Application No. 081880/2001, filed Mar. 22, 2001.

BACKGROUND OF THE INVENTION

1. Field of the Invention

The present invention relates to a driving circuit of a light-emitting element for an image display apparatus, more specifically to a driving circuit for an active matrix type light-emitting element for controlling a self-luminous element such as organic and inorganic electroluminescence elements and light-emitting diodes (hereinafter the "electroluminescence" being referred to as "EL"; the "light-emitting diode" being referred to as "LED"). The present invention relates also to an active matrix type display panel employing the aforementioned driving circuit.

2. Related Background Art

The display units which display characters with a dot matrix of light-emitting elements such as organic or inorganic EL light-emitting elements and LED combined in an array are widely used in televisions and portable terminals.

In particular, the displays employing a self-luminescent element are attracting attention, since such a display does not require a backlight for illumination and has a wide view angle and other features, differently from the display units employing liquid crystals. Among them, active matrix types of displays which are driven statically by combination of transistors or the like with the above light-emitting elements come to be noticed because of high luminance, high contrast, high fineness, and other superiority in comparison with simple matrix-driven display units conducting time-divisional driving.

The systems employing an organic EL element also include analog gradation systems, areal gradation systems, and time-controlled gradation systems similarly as conventional systems for gradation of the image.

(1) Analog Gradation System

As an example of conventional analog systems, FIG. 7 shows a simplest display element of an active matrix-driven light-emitting element which is provided with two thin film transistors (hereinafter being referred to as "TFT") for one pixel. In FIG. 7, the numerals indicate the members as follows: 101, an organic EL element; 102 and 103, a TFT respectively; 108, a scanning line; 107, a signal line; 109, a power line; 110, a ground potential; and 111, a memory capacitance employing a condenser.

The operation of this driving circuit is explained below. With TFT 102 turned on by scanning line 108, an image data voltage from signal line 107 is accumulated in memory capacitance 111. Even after TFT 102 is turned off by turning-off of scanning line 108, the aforementioned voltage is kept applied to the control electrode of TFT 103 to keep TFT 103 in an ON state.

On the other hand, the first main electrode of TFT 103 is connected to power line 109; the second main electrode thereof is connected to the first electrode of the light-emitting element; and the control electrode thereof is connected to the second electrode of TFT 102 to input the image data voltage. The quantity of the electric current is controlled by the aforementioned image data voltage. Organic EL element 101, which is placed between power line 109 and grounding potential 110, emits light in accordance with the electric current quantity.

The above electric current quantity is controlled by the control voltage of TFT 103. The luminance of the light emission is changed by changing the current characteristics in an analog manner by utilizing the region where the characteristic of the first main electric current (Vg-Is characteristics) relative to the aforementioned control voltage rises (the region being referred to as the "saturation region").

Consequently, the light emission luminance of the organic EL element as the light-emitting element is controlled to conduct display with gradation. This system of display with gradation is called an analog gradation system since the analog image data voltage is utilized.

The currently used TFTs include amorphous silicon (a-Si) type ones and polysilicon (p-Si) type ones. The polycrystalline silicon TFTs are becoming more important in view of the high mobility, possibility for fineness of the element, and possibility for low-temperature production process owing to the laser working technique progress. However, the polycrystalline silicon TFT is liable to be affected by the grain boundary of the constituting crystal grains, and tends to have the Vg-Is current characteristics varying among the TFT elements. As the results, even with uniform video signal voltage inputted to the elements, the display can be irregular disadvantageously.

Generally, most of TFTs are used merely as a switching element, and are used by application of control voltage much higher than the threshold voltage of the transistor in the region where the voltage of the second main electrode is constant relative to the voltage of the first main electrode (the region being called a linear region), whereby the variance is less liable to be caused in the aforementioned saturation region. On the other hand, this method utilizing the saturation region is liable to cause variance.

Further, in this system, the image data signal should be changed corresponding to the luminance-voltage characteristic of the organic EL element. Since the voltage-current characteristic of the organic EL element is similar to the nonlinear diode characteristic, the voltage-luminance characteristic has also a steep rise like the diode characteristic. Therefore, the image data signals should be treated for gamma correction, which makes the drive control system complicated.

(2) Areal Gradation System

An areal gradation system is proposed in a paper, AM-LCD2000, AM3-1. In this system, one pixel is divided into subpixels; the subpixels are turned on or off independently; and the gradation is expressed by the area of the pixels in an ON state. FIG. 8 shows a planar constitution of a pixel divided into six subpixels.

In such a system, the TFT can be driven at a control voltage much higher than the threshold voltage in the linear region where the voltage of the second main electrode is constant relative to the voltage of the first main electrode, whereby the TFT can be used with stable TFT characteristics, resulting in stable luminance of the light-emitting element. In this system, the respective elements are controlled to be on and off, and emit light at a constant luminance without gradation, the gradation being controlled by the area of the subpixels emitting light.

This system is limited to digital gradation because of the division into subpixels. To increase the levels of gradation, the number of division should be increased with decrease of the area of one subpixel. Even if the transistors are made finer by use of polycrystalline silicon TFT, the transistor portion of each of the pixel decreases the area of the light-emitting portion to lower the pixel aperture ratio, resulting in decrease of the luminance of the emitted light of the display panel. Therefore, increase of the numerical aperture lowers the gradation. Thus, the brightness and the gradation are in a relation of trade-off, so that the improvement of the gradation is not easy.

(3) Time-controlled Gradation System

The time-controlled gradation system controls the gradation by the light-emitting time of the organic EL element, as reported in a paper, 2000SID36.4L.

FIG. 9 shows an example of a circuit diagram of one pixel of a conventional display panel employing the time-controlled gradation system. In FIG. 9, the same reference numerals as in FIG. 7 are used for indicating the corresponding members. The numeral 104 indicates a TFT, and the numeral 112 indicates a reset line.

In the time-controlled gradation system employing this circuit construction, when TFT 103 is turned on, organic EL element 101 emits light at the highest luminance level by the voltage from power line 109. Then, TFT 104 is driven to turn TFT 103 on and off suitably and repeatedly with in a time of one field to display the gradation by the light-emitting time duration.

In this type of system, one field is divided into plural subfield periods, and the light-emitting time is controlled by the light-emitting periods. For example, to display 8 bits (256 gradation levels), the ratio of the light-emitting time is selected from eight subgroups of periods of 1:2:4:8:16:32:64:128. Immediately before each of the subfield periods, an addressing period is necessary for the scanning lines of the all of the pixels to select emission or no-emission of light in the respective subfields. After the addressing period, the voltages of source lines 109 are simultaneously changed to emit light from the entire face of the display panel.

Therefore, since the display is not conducted in the addressing period in principle, the effective light-emission period in one field for N-bit gradation display is represented by the relation below:

$$\text{(Effective light emission period)}=\text{(One field period)}-\text{(One picture addressing period}\times N\text{)}$$

Thereby, the light emission time is made shorter, and the amount of the light emission is less for the observer.

To offset such disadvantages, it is desirable to increase the light-emission amount of one subfield to increase the light emission of the entire fields. For this purpose, the light-emission luminance of the respective light-emitting elements should be increased, which can result in shorter life of the light-emitting elements and other disadvantages. Further, although a usual liquid display (LCD) requires only one time of addressing for one field, this type of the gradation system requires the addressing times of the gradation bits for one field, which necessitates a higher speed of the addressing circuit.

SUMMARY OF THE INVENTION

To solve the above problems in driving the light-emitting elements, the present invention intends to provide a novel driving circuit for stable gradation display of an active matrix type light-emitting element.

As described above, several problems are involved in driving a light-emitting element by a TFT. In particular, for turning the TFT on and off in a shorter time, a more transient-responsive drive characteristic region of the TFT is utilized, which will result in increase of variance of TFT characteristics.

One method to solve the problem is to lengthen the TFT operation time, and another method is to decrease the quantity of the electric current during the time for ON and OFF.

Firstly, the electric state of the light emitting element is explained briefly.

The organic EL element has a constitution in which organic layers of a light-emitting layer, an electron-transporting layer, a hole-transporting layer and the like layer laminated between an anode and a cathode. The junction of such materials having different energy band structures will give invariably a junction capacitance at the junction interface of the materials. The thicknesses of the layers are about 100 nm, and the capacitance between the electrodes is about 25 nF/cm$^2$ as the synthetic capacitance. Therefore, a pixel of 100 $\mu$m×100 $\mu$m is estimated to have a capacitance of 2.5 pF. This capacitance is much larger than that of a liquid crystal element.

In the matrix arrangement of the above light-emitting elements, the elements in the number of the pixels are arranged juxtapositionally. This gives a heavy load to the outside driving circuit. Further, the signals outputted from the outside driving circuit are deformed in the waveform owing to the aforementioned element capacitance and wiring resistance, which can shorten the period for effective voltage application to the light-emitting elements or the like.

The inventors of the present invention found that the time for charging the electric capacitance of the light-emitting element affects the substantial response speed of the light-emitting element, and tried to reduce this adverse effect.

Assuming the case where a light-emitting element is driven by an electric current from a current source, the electric current firstly charges the electric capacitance to fix the potential between the electrodes, and after the prescribed threshold voltage is attained, the injection of the electrons begins to emit the light. The time for charging the electric capacitance is estimated as below.

In the organic EL element, the driving current for achieving the maximum light-emission efficiency is about 2 to 3 $\mu$A for a pixel size of 100 $\mu$m×100 $\mu$m.

For achieving an 8-bit gradation levels in an analog gradation system, the minimum electric current is calculated as follows: 2 to 3 $\mu A \div 2^8 \cong 8$ to 12 nA.

In the case where the above current of 8 to 12 nA is allowed to flow from the current source for obtaining a minimum luminance, the time required for charging the aforementioned electric capacitance is estimated as below.

Generally, the light-emission threshold voltage of an organic EL element ranges 2 to 3 volts. From the relation:

$$\text{Capacitance } C\times\text{Threshold voltage } Vth=\text{Minimum current } I\text{min}\times\text{Time } t,$$

$$\text{Time } t=2.5\text{ pF}\times 2\text{ to }3\text{V}/8\text{ to }12\text{ nA}\cong 420\ \mu\text{s to }940\ \mu$$

In a usual VGA class display apparatus employing about 400 scanning lines, the selection time for one scanning line is about 30 $\mu$s. Therefore, in the VGA class image display apparatus, even the light emission of a darkest state cannot be achieved, and the display apparatus is not useful.

On the other hand, the time-controlled gradation system obtains the gradation by turning on and off the light-emitting elements at the highest luminance in one frame. Now, light-emission time gradation for minimum luminance is considered. For obtaining an 8-bit gradation, the minimum time of the ON-state is calculated for a field of 60 Hz as $1/60 \div 2^8 \cong 65\ \mu s$.

For the same pixel size as above, with the largest electric current applied from the power source, the time necessary before the light emission is calculated as below:

$$t = 2.5\ \text{pF} \times 2 \text{ to } 3\text{V} \div 2 \text{ to } 3\ \mu\text{A} \cong 1.7 \text{ to } 3.75\ \mu s.$$

This time length will not give serious influence on the light emission time.

However, the studies are being made for improvement of the light emission efficiency to achieve a long life and low power consumption as mentioned above, and the target is to obtain a. highest efficiency at 100 to 200 nA.

In this case, the time t required before the light emission is estimated to be t=25 to 75 $\mu$s. Therefore, the minimum luminance may not be achieved by the time-controlled gradation system also.

The present invention provides a novel driving circuit for the active matrix type organic EL element, and to provide an element which is capable of conducting gradation display stably by time-controlled gradation to solve the above problems.

To solve the above problems, the present invention provides a driving circuit of an active matrix type light-emitting element having scanning lines and signal lines formed in an matrix on a substrate comprised of a light-emitting element, plural transistors, a constant current source and a grounding potential at or near an intersection of the scanning line and the signal line, the driving circuit being characterized in that the driving circuit has a circuit assembly comprised of a circuit having a light emitting element and a first transistor connected in series and a second circuit comprising a second transistor and connected in parallel to the first circuit, and that the constant current source, the circuit assembly and the grounding potential are connected in series.

The present invention includes the driving circuit of an active matrix type light-emitting element, in which the light-emitting element, the transistors, the constant current source and the grounding potential are connected in the order of a power line, the circuit assembly comprising the first circuit having the light-emitting element connected at the side of the power line, and the grounding potential with interposition of the constant current source. The embodiment includes the driving circuit in which the connecting constitution is characterized in that the anode of the light-emitting element and the second main electrode of the second transistor are connected in common to the power line, that the cathode of the light-emitting element is connected to the second main electrode of the first transistor in the first circuit, that the first main electrode of the first transistor and the first main electrode of the second transistor are connected in common to one electrode of the constant current source, and that the other electrode of the constant current source is connected to the grounding potential. In this embodiment, the first and second transistors may be N-channel transistors. Otherwise, in that embodiment, the driving circuit of an active matrix type light-emitting element according to claim 3, which further comprises a first memory circuit comprised of a third transistor having a control electrode connected to the scanning line and a first main electrode connected to the signal line and a memory capacitance one electrode of which is connected to the grounding potential, wherein a second main electrode of the transistor is connected in common to the memory capacitance and a control electrode of the first transistor. Otherwise, the driving circuit of an active matrix type light-emitting element according to claim 3, which further comprises the first memory circuit and a second memory circuit comprised of a forth transistor having a control electrode connected to the scanning line and a first main electrode receiving a reversed signal from the signal line and a memory capacitance one electrode of which is connected to the grounding potential, wherein a second main electrode of the transistor is connected in common to the memory capacitance and a control electrode of the second transistor.

The above invention includes the driving circuit of an active matrix type light-emitting element in which the order of the connection of the light-emitting element, the plural transistors, the constant current source and the grounding potential is reverse to the above constitution. More specifically, in such a constitution, the light-emitting element, the transistors, the constant current source and the grounding potential are connected in the order of a power line, the circuit assembly comprising the first circuit having the first transistor connected at the side of the power line with interposition of the constant current source, and the grounding potential. In this embodiment, in the connecting constitution of the driving circuit, the order is reversed such that the first main electrode of the first transistor and the first main electrode of the second transistor are connected to the power line, that the second main electrode of the first transistor is connected to the anode of the light-emitting element, and that the cathode of the light-emitting element and the second main electrode of the second transistor are connected in common to the grounding potential. In this embodiment, the first and second transistors are preferably P-channel transistors. Otherwise, the phase of a first main signal of the third transistor and the phase of a first main signal of the fourth transistor are reversed.

The present invention includes the driving circuit of an active matrix type light-emitting element in which the first transistor and the second transistor are operated differentially to be turned off and on alternately.

The present invention includes the driving circuit of an active matrix type light-emitting element in which the light-emitting element is controlled to be turned on and off by turning on and off the first and second transistors in accordance with information from the scanning line and the signal line. In that driving circuit of an active matrix type light-emitting element, gradation is preferably made by controlling the light emission quantity of the light-emitting element per time by turning on and off the light-emitting element in accordance with information from the scanning line and the signal line.

The present invention includes the driving circuit of the active matrix type light-emitting element in which the light-emitting element is an organic electroluminescence element or an inorganic electroluminescence element.

The present invention provides also an active matrix type of light-emitting device, which has the above driving circuit of the active matrix type light-emitting elements.

DESCRIPTION OF THE PREFERRED EMBODIMENTS

Figure 1:
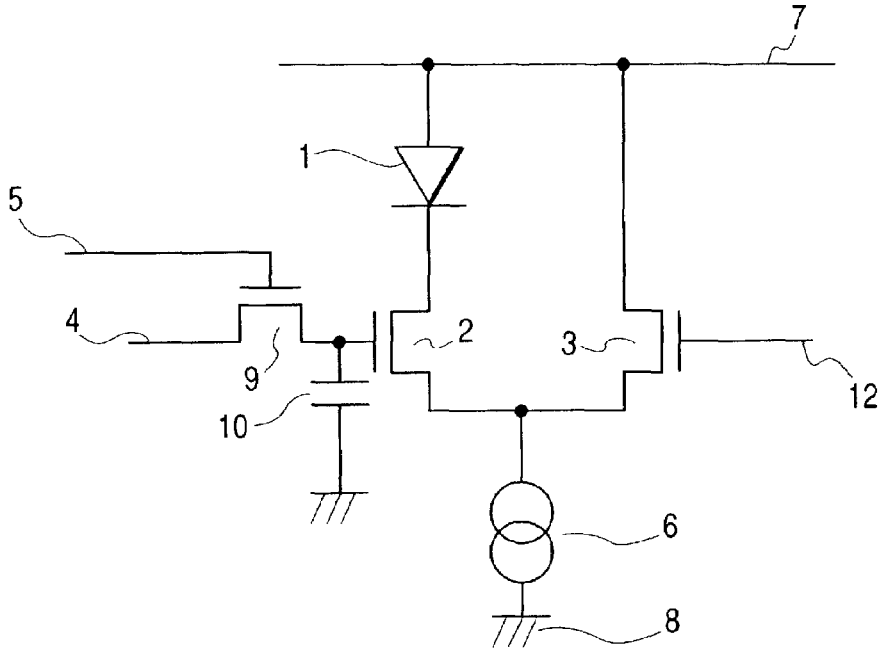
FIG. 1 shows an example of one pixel circuit of the present invention.

The present invention is described below specifically by reference to drawings without limiting the invention. In the drawings, the same reference symbols are used for indicating the corresponding members.

EXAMPLE 1

FIG. 1 shows a first example of a pixel circuit which is a constitutional element of the present invention. In FIG. 1, the numeral indicates the members as follows: 1, a light-emitting element (an organic EL element in this example); 2, a first transistor (a thin film transistor TFT in this example); 3, a second transistor; 4, a signal line; 5, a scanning line; 6, a constant current circuit; 7, a power line: 8, a grounding potential; 9, a third transistor; 10, a memory capacitance employing a condenser; and 12, a control electrode of TFT 3.

The circuit constitution of the present invention is explained below in which a thin film transistor is employed as the transistor.

The constitution of FIG. 1 comprises a first circuit which has organic EL element 1 and the second main electrode of TFT 2 connected in series, and a second circuit which has TFT 3 connected between power line 7 and constant circuit 6 in series, the first circuit and the second circuit being connected electrically in parallel. In the first circuit, the cathode of organic EL element 1 is connected to the second main electrode of the first transistor TFT 2. The anode of organic EL element 1 and the second main electrode of the second transistor TFT 3 are connected to power line 7. The first electrode of TFT 2 and the first electrode of TFT 3 are both connected to constant current circuit 6. The other end of constant current circuit 6 is connected to grounding potential 8. Thus, as a whole, a pixel circuit comprised of the first circuit and the second circuit, and the constant current circuit are connected in series between power line 7 and grounding potential 8.

The light-emitting element is turned on only during the period in which TFT 3 is turned off and TFT 2 is turned on, or electric current is allowed to flow through the first circuit owing to the conductance relation between the first circuit and the second circuit.

In the case where light emission display is conducted by a digital gradation system in 256 gradation levels, the organic EL element can be turned off by application of an electric current in a quantity less than that necessary for the minimum luminance, preferably a fraction thereof; and the maximum luminance can be achieved by application of an electric current in a quantity of 256 times that for the minimum luminance. Therefore, the conductance of the second circuit and the conductance of the first circuit are in a relation of reciprocal. The range thereof is preferably from 1/256 to 256, the on-off ratio of three digits being sufficient.

In this case, where the potentials to be inputted to the first and second main electrodes of TFT 2 and TFT 3 is the same, the channel width W and the channel length L of TFT 3 are changed to satisfy the above relation.

The constitution of FIG. 1, has a first memory circuit comprising a third transistor TFT 9 and memory capacitance 10 to retain for a certain period the voltage inputted into the signal line when a scanning line 5 is selected. Generally, at the timing of selection of the scanning line 5, the control of TFT 9 is turned on to accumulate the signal of signal line 4 in memory capacitance 10 and to retain it for the one field period. This voltage is applied to the control electrode of the TFT to turn on TFT 2. In this state, it is controlled whether the light emission of organic EL element 1 is carried out, by turning-on or turning-off by the signals (multiplexer signals) inputted to the second transistor TFT 3.

Figure 2:
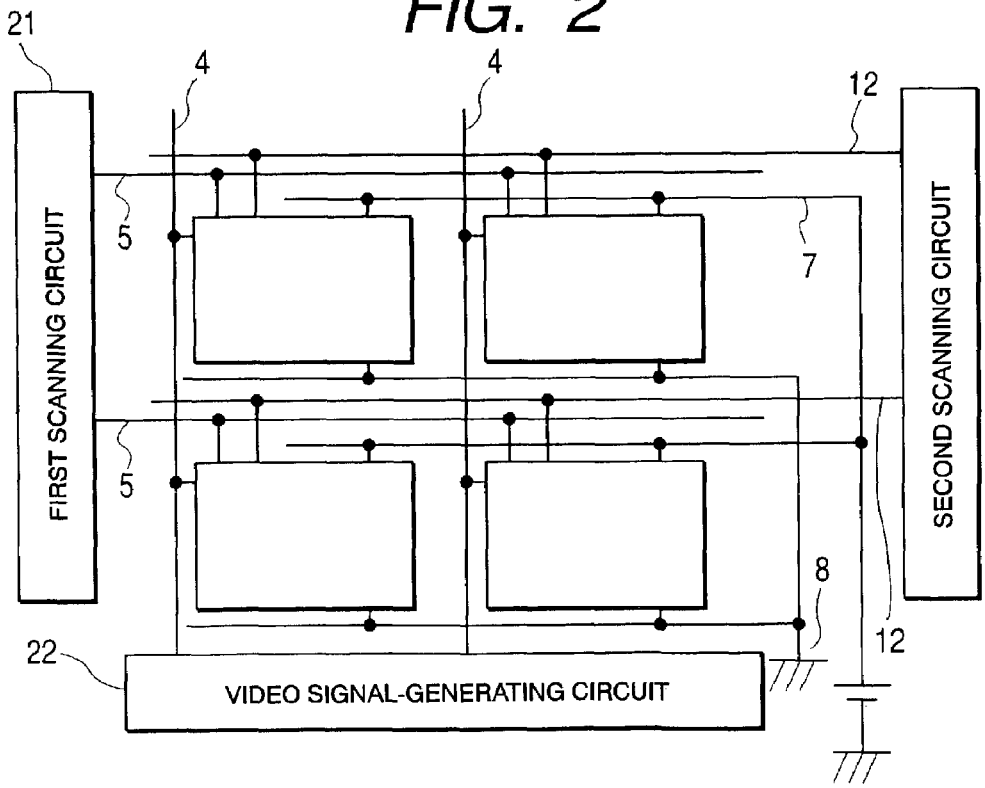
FIG. 2 shows a circuit of an example having a matrix wiring of the above circuit of the present invention.

FIG. 2 shows an arrangement of the circuits of the above constitution in an XY matrix. In FIG. 2, the numeral 21 indicates a first scanning circuit, and the numeral 22 indicates a video signal-generating circuit.

In FIG. 2, the quadrangle shows simply the circuit constitution shown in FIG. 1. In this example, as the signals to be inputted to the control electrode of FIG. 1, the multiplexer signals outputted from the second scanning circuit are employed. In the circuit constitution of each of the pixel units, the circuit constitution of FIG. 1 is placed between power line 7 and grounding potential 8, and the organic EL elements are turned on and off in accordance with information from scanning line 5 and signal line 4 and signals from the second scanning circuit.

There are two cases for the signal voltage levels inputted to control electrode 12 of the second transistor TFT 3 in relation to the voltage of signal line 4 inputted to control electrode of TFT 2:

(1) the potential being fixed between the high level and low level of the signal line potential, and (2) a potential having the high level and the low level of the signal line potential being reversed in the phase.

Thereby, TFT 2 and TFT 3 can be turned on and off differentially.

Figure 3:
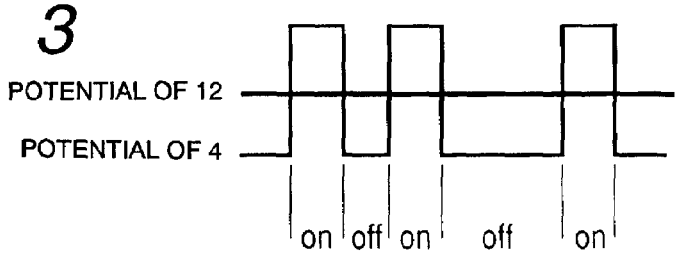
FIG. 3 shows a relation between the electrode potentials of TFT 2 and TFT 3.

The relation of the potentials in the above Case (1) is explained by reference to FIG. 3. In FIG. 3, the indication of "on" and "off" signify the periods of the ON-state and the OFF-state of the light-emitting element.

The potential of electrode 12 is set at the intermediate level of potential amplitude of electrode 4. The transistor is designed to turn on TFT 3 by application of a low-level voltage from signal line 4 owing to the higher voltage of electrode 12. On the other hand, the transistor is designed to turn off TFT 3 and to turn on TFT 2 by application of a high-level voltage from signal line 4 owing to the lower voltage of electrode 12. Thus, in the case where TFT 2 and TFT 3 are both constituted of an N channel transistor, the ON-state and the OFF-state thereof are reversed to drive differentially.

Figure 4:
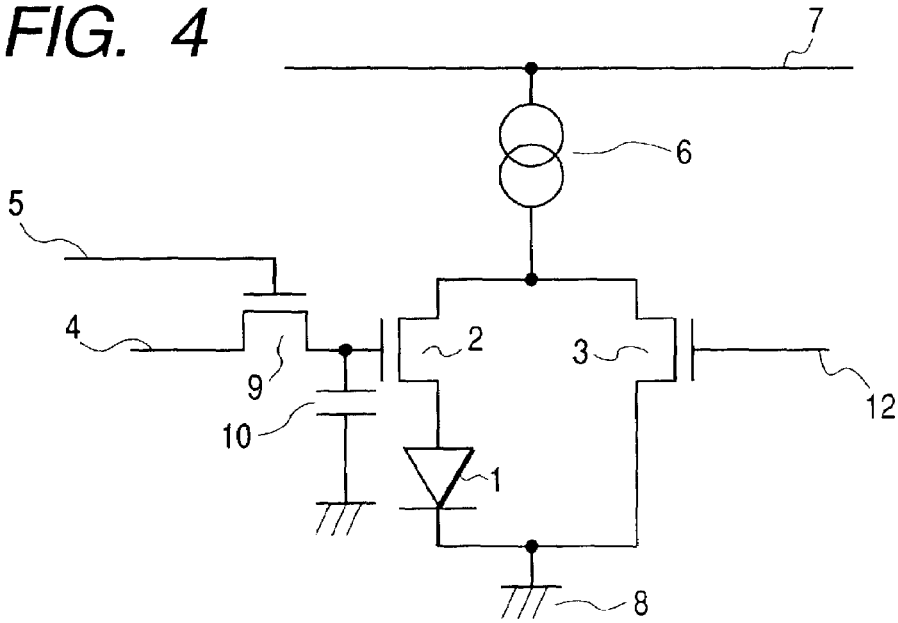
FIG. 4 illustrates an example of another pixel circuit of the present invention.

FIG. 4 shows another connecting constitution of the present invention.

In the pixel circuit, the order of the serial connection of the first circuit and the second circuit and the constant current circuit may be made reverse to that of the above example. However, in such a case, for allowing the bias current to flow as mentioned later, the second main electrode of the first transistor TFT 2 is preferably connected to the anode of the organic EL element in the first circuit.

This circuit is different from the circuit of FIG. 1 in that the arrangement of the circuit assembly and the constant current source are reversed in relation to the power line, and correspondingly the connection of the first transistor with the light-emitting element in the first circuit is reversed. For use in this constitution, the transistor is preferably a P-channel transistor. The method of the on-off control of the light-emitting element, which is a basic requirement of the circuit, is the same as that explained by reference to FIG. 1.

Figure 5:
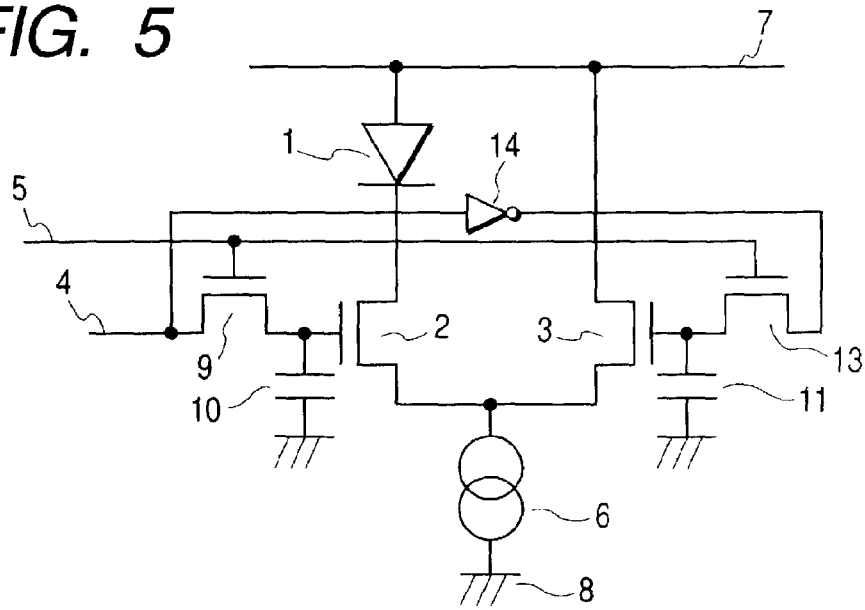
FIG. 5 illustrates an example of still another pixel circuit of the present invention.

FIG. 5 shows concretely the circuit constitution corresponding to the above Case (2) based on the circuit shown in FIG. 1. This circuit constitution has a second memory circuit comprising a fourth transistor and a memory capacitance in addition to the circuit shown in FIG. 1.

In FIG. 5, the signal from scanning line 5 is inputted to the control electrodes of the third and fourth transistors connected commonly. The information of signal line 4 is inputted directly to one of the electrodes of the third transistor, and is inputted through inverter 14 to one of the electrodes of the fourth transistor.

Thereby, the phase of the signals applied to the control electrodes of the first transistor and the second electrode and second are reversed, and the operation for ON and OFF is reversed between the first transistor and the second transistor. Therefore, this constitution enables differential operation, too.

This circuit, although it requires additionally an electrode wiring for the third transistor and the fourth transistor in the pixel, does not require the second scanning circuit and wiring 12 shown in FIG. 2, which is advantageous in the circuit arrangement.

Otherwise, without inverter 14, the fourth transistor TFT 13 can be constituted to operate in the polarity reverse to that of TFT 2. Therefor, the inverter is made unnecessary by employing P-channel transistor as TFT 13 for TFT 2 of N-channel transistor.

With the above constitution, the time-controlled gradation can be conducted by turning TFT 3 on and off.

In the constitution of FIG. 1, even in the period in which TFT 2 is in an ON-state, turning-on of TFT 3 turns off the light-emitting element. Therefore, in this constitution, the display of the light-emitting element can be controlled also by turning-on and off of TFT 3. Further, in the constitution of FIG. 4, the time-controlled gradation can be conducted by application of on-off signals from signal line 4 during the addressing period.

Figure 6:
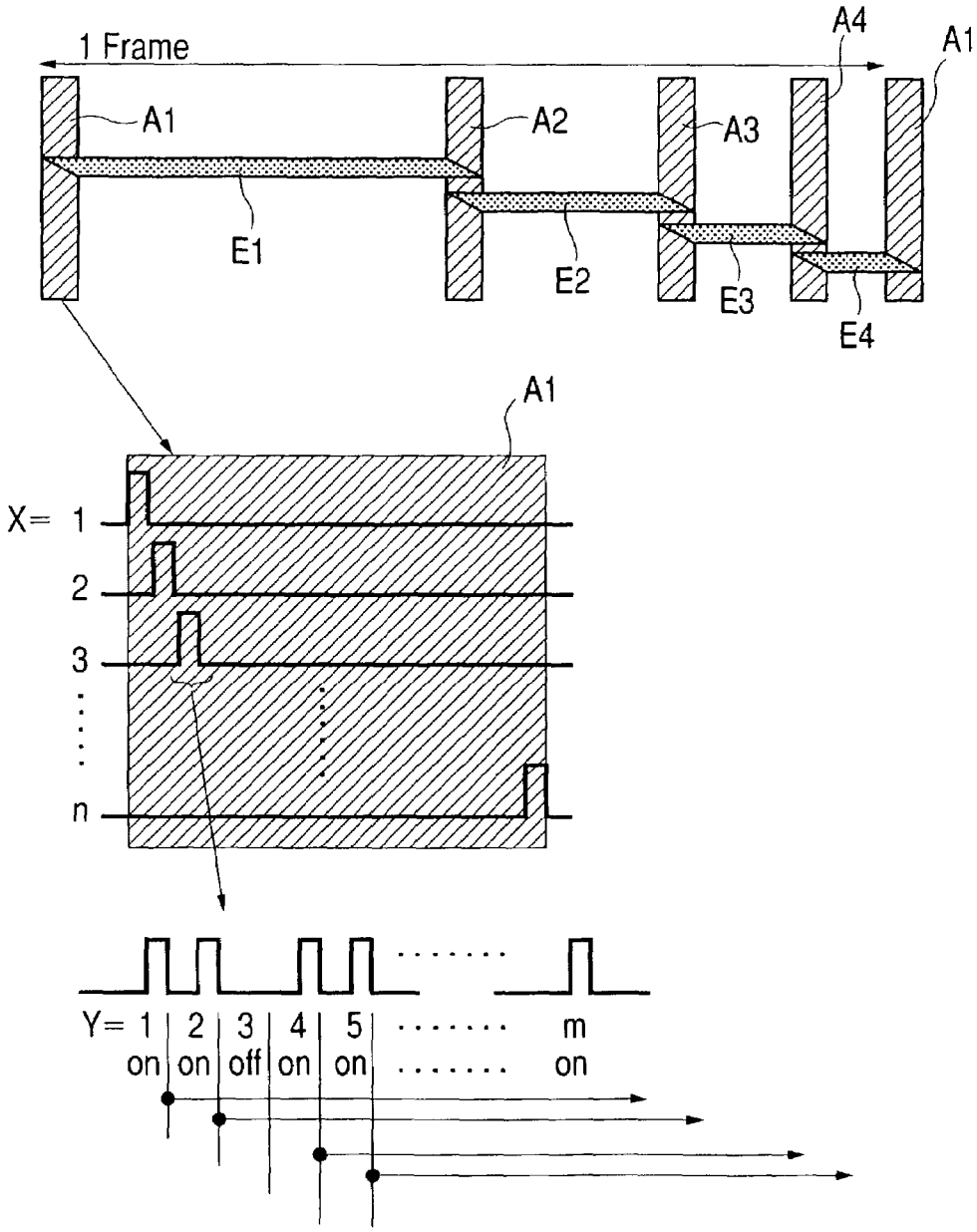
FIG. 6 shows a timing chart in time-controlled gradation.
Figure 7:
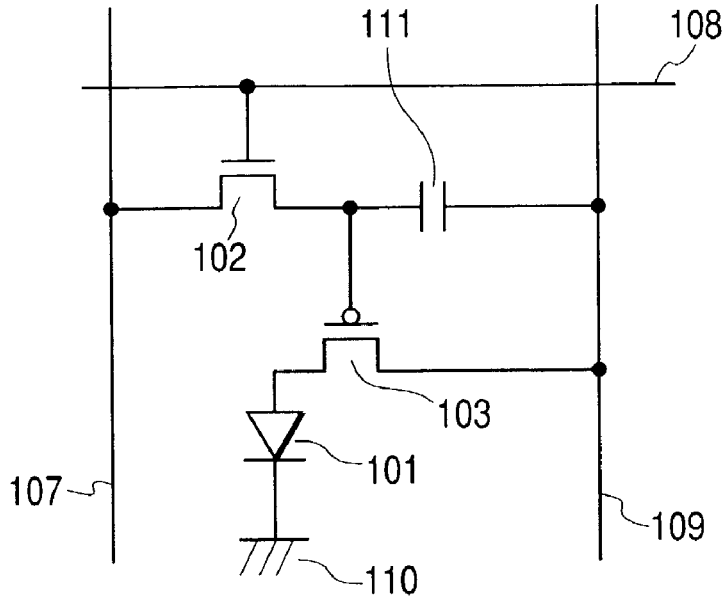
FIG. 7 shows a conventional pixel circuit.
Figure 8:
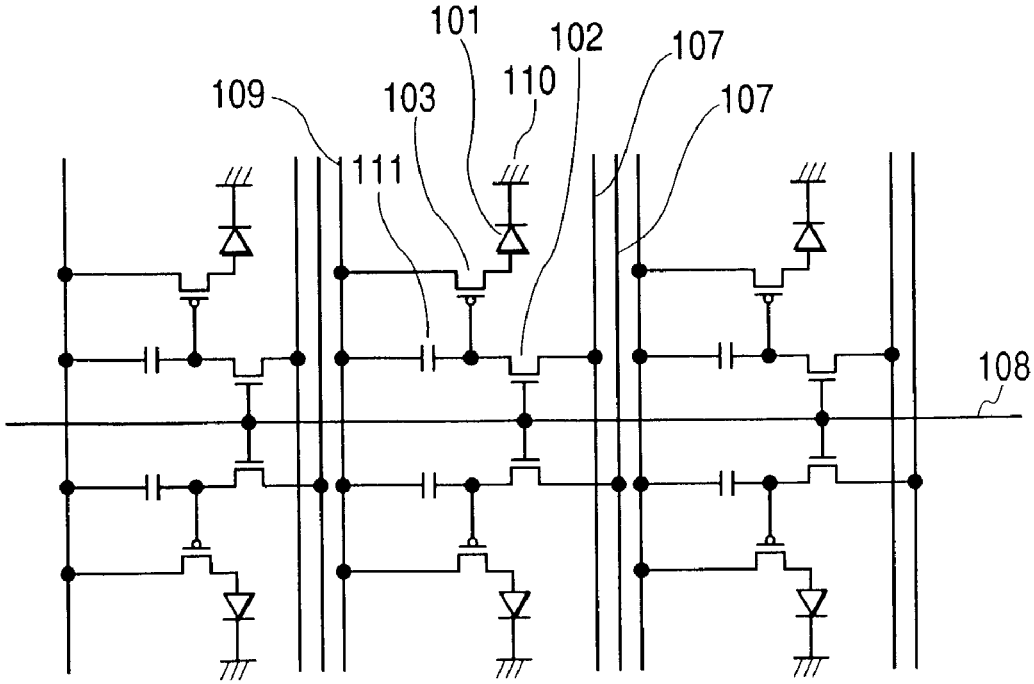
FIG. 8 shows a conventional pixel arrangement of a display panel time for conducting areal gradation.
Figure 9:
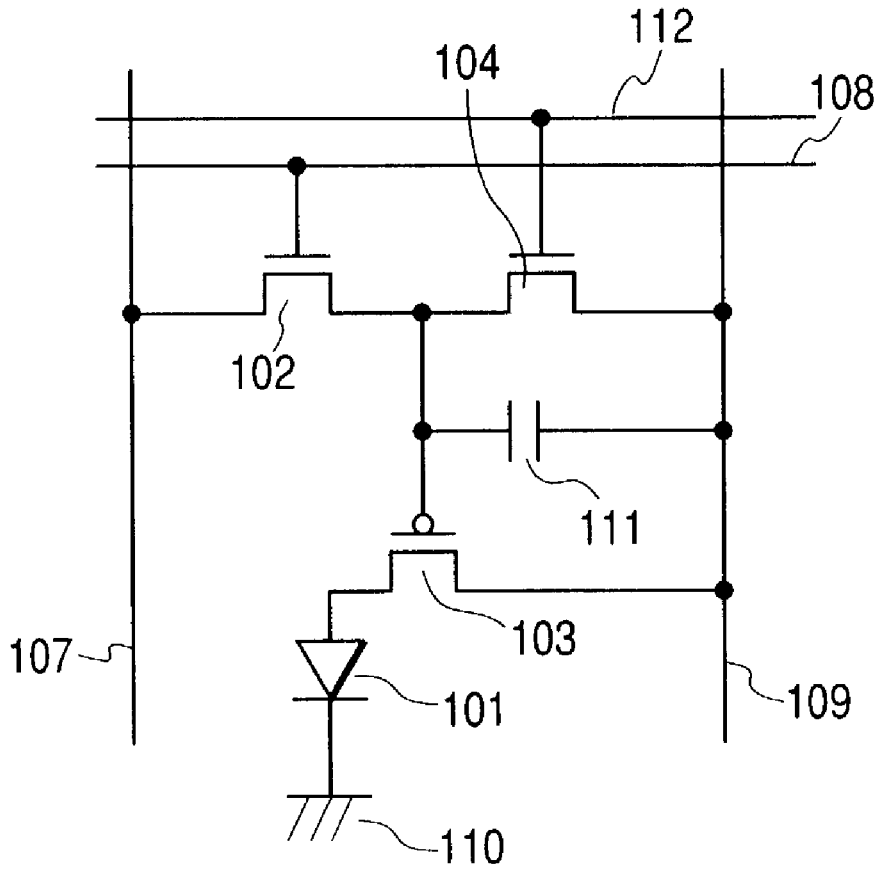
FIG. 9 shows a conventional pixel arrangement of a display panel time for conducting time-controlled gradation.

The timing in the time-controlled gradation by dividing one frame into four subfield (8, 4, 2, 1) is explained by reference to FIG. 6. In FIG. 6, the symbols A1 to A4 indicate addressing periods of the respective subfields. In period Al, scanning signals are applied through respective scanning lines X=1 to n for a matrix successively. In the respective scanning periods, on/off signals of Y=1 to m for the pixels are applied through the signal lines, whereby the respective pixels begin to emit light. The periods indicated by E1 to E4 are light-emission period of each subfield, and are called PWM-controlled light emission period. In the first addressing period, a scanning signal is applied to scanning line 5 to turn on TFT 2. By application of the signal from signal line 4 in the above addressing period, the pixels on the same scanning line emit light immediately after application of the signal from the signal line, and the state can be maintained by memory capacitances 10 and 11 until the next signal is applied in the next addressing period. According to this method, in the addressing period, each of the display bits addressed in the addressing period begins light emission, and keep the light emission until the next addressing. For example, following the light emission of the first addressed bit (e.g., left-top pixel), the bits successively emit light to the last bit (right-bottom pixel). The light emission continues until the next addressing. In such a manner, each of the pixels emits light nearly throughout the subfield period, whereby a bright light-emitting element can be obtained.

In this method, the respective light-emitting elements emit light in the highest emission state, which gives excellent gradation reproducibility with less variance of the elements in comparison with the aforementioned analog light emission state.

With the above circuit constitution, TFT 2 and TFT 3 can be operated differentially, and the driving signals can be transmitted at a lower voltage to reduce the power consumption advantageously. In the circuit constitution of the present invention, a constant electric current is allowed to flow by the constant current circuit, whereby the electric current density is kept constant and the luminance level of the light emission is kept constant advantageously.

Further, by the time-controlled gradation display with the circuit constitution of the present invention, the period of the light emission can be made longer, which enables bright display with a lowered level of the maximum luminance. This is very effective for the life of the element.

With the first circuit and the second circuit constituted as above, the ratio of the current flowing through the respective circuits can be controlled by the voltage inputted from the signal line and the voltage inputted from the scanning line. Therefore, the luminance of the light emission in an analog manner can be obtained by controlling the resistivities of the two transistors to control the current flow through organic EL element 1 in an analog manner.

In FIGS. 1, 4, and 5, constant current circuit 6 is provided for each of the pixels. However, it may be provided in common for each row of the pixels. In this constitution, the intensity of the current is designed to be the sum of the current through TFT 2 and TFT 3 multiplied by the number of the connected pixels. Although the constant current circuit 6 can be made common to all of the pixels, the intensity of the current becomes a multiple of number of the pixels, which is excessively large. Therefore, the combination thereof should be selected suitably.

As described above, according to the present invention, two transistors are employed complementarily and operated differentially, whereby the organic EL element can be turned on and off with stable constant current at a high speed. Accordingly, the driving circuit of the present invention improves the gradation expression of the image to give high image quality expression, and provides a display panel of low power consumption.

What is claimed is:

1. A driving circuit of an active matrix type light-emitting element, the driving circuit comprising:

scanning lines and signal lines formed in a matrix on a substrate;

first and second transistors;

a constant current source; and a grounding potential at or near an intersection of one of the scanning lines and one of the signal lines;

wherein the driving circuit has a circuit assembly comprised of (i) a first circuit having the light-emitting element and the first transistor connected in series, and (ii) a second circuit comprised of the second transistor and connected in parallel to the first circuit, wherein the constant current source, the circuit assembly, and the grounding potential are connected in series, wherein the connecting constitution of the driving circuit is characterized in that a first main electrode of the first transistor and a first main electrode of the second transistor are connected in common to one electrode of the constant current source, that the other electrode of the constant current source is connected to the grounding potential, that the cathode of the light-emitting element is connected to a second main electrode of the first transistor, and that the anode of the light-emitting element and a second main electrode of the second transistor are connected in common to a power line, and wherein the driving circuit further comprises a first memory circuit comprised of (i) a third transistor having a control electrode connected to the one of the scanning lines and a first main electrode connected to the one of the signal lines and (ii) a memory capacitance one electrode of which is connected to the grounding potential, with a second main electrode of the third transistor being connected in common to the memory capacitance and a control electrode of the first transistor.

2. The driving circuit of an active matrix type light-emitting element according to claim 1, wherein the first and second transistors are N-channel transistors.

3. The driving circuit of an active matrix type light-emitting element according to claim 1, which further comprises a second memory circuit comprised of (i) a fourth transistor having a control electrode connected to the one of the scanning lines and a first main electrode receiving a reversed signal from the one of the signal lines and (ii) a memory capacitance one electrode of which is connected to the grounding potential, wherein a second main electrode of the fourth transistor is connected in common to the memory capacitance of the second memory circuit and a control electrode of the second transistor.

4. The driving circuit of an active matrix type light-emitting element according to claim 1, wherein the first transistor and the second transistor are operated differentially to be turned off and on alternately.

5. The driving circuit of an active matrix type light-emitting element according to claim 1, wherein the light-emitting element is controlled to be turned on and off by turning on and off the first and second transistors in accordance with information from the one of the scanning lines and the one of the signal lines.

6. The driving circuit of an active matrix light-emitting element according to claim 5, wherein gradation is made by controlling the light emission quantity of the light-emitting element per time by turning on and off the light-emitting element in accordance with information from the one of the scanning lines and the one of the signal lines.

7. The driving circuit of the active matrix type light-emitting element according to claim 1, wherein the light-emitting element is an organic electroluminescence element or an inorganic electroluminescence element.

8. An active matrix type of light-emitting device, which has the driving circuit of the active matrix type light-emitting element set forth in claim 1.

9. A driving circuit of an active matrix type light-emitting element, the driving circuit comprising:

scanning lines and signal lines formed in a matrix on a substrate;

first and second transistors;

a constant current source; and a grounding potential at or near an intersection of one of the scanning lines and one of the signal lines;

wherein the driving circuit has a circuit assembly comprised of (i) a first circuit having the light-emitting element and the first transistor connected in series, and (ii) a second circuit comprised of the second transistor and connected in parallel to the first circuit, wherein the constant current source, the circuit assembly, and the grounding potential are connected in series, wherein the connecting constitution of the driving circuit is characterized in that a first main electrode of the first transistor and a first main electrode of the second transistor are connected to in common to one electrode of the constant current source, that the other electrode of the constant current source is connected to a power line, that a second main electrode of the first transistor is connected to the anode of the light-emitting device, and that the cathode of the light-emitting element and a second main electrode of the second transistor are connected in common to the grounding potential.

10. The driving circuit of an active matrix type light-emitting element according to claim 9, wherein the first and second transistors are P-channel transistors.

11. The driving circuit of an active matrix type light-emitting element according to claim 9, wherein the phase of a first main signal of the first transistor and the phase of a first main signal of the second transistor are reversed.

12. The driving circuit of an active matrix type light-emitting element according to claim 9, wherein the first transistor and the second transistor are operated differentially to be turned off and on alternately.

13. The driving circuit of an active matrix type light-emitting element according to claim 9, wherein the light-emitting element is controlled to be turned on and off by turning on and off the first and second transistors in accordance with information from the one of the scanning lines and the one of the signal lines.

14. The driving circuit of an active matrix light-emitting element according to claim 13, wherein gradation is made by controlling the light emission quantity of the light-emitting element per time by turning on and off the light-emitting element in accordance with information from the one of the scanning lines and the one of the signal lines.

15. The driving circuit of the active matrix type light-emitting element according to claim 9, wherein the light-emitting element is an organic electroluminescence element or an inorganic electroluminescence element.

* * * * *

UNITED STATES PATENT AND TRADEMARK OFFICE

CERTIFICATE OF CORRECTION

PATENT NO. : 6,992,663 B2
APPLICATION NO. : 10/247626
DATED : January 31, 2006
INVENTOR(S) : Hiroyuki Nakamura et al.

It is certified that error appears in the above-identified patent and that said Letters Patent is hereby corrected as shown below:

COVER PAGE:
(57) ABSTRACT
Line 2, “elements” should read -- element --.

COLUMN 2:
Line 25, “the results,” should read -- a result, --; and
Line 66, “division” should read -- divisions --.

COLUMN 3:
Line 23, “with in” should read -- within --; and
Line 32, “the” (second occurrence) should be deleted.

COLUMN 4:
Line 44, “levels” should read -- level --; and
Line 57, “940 μ” should read -- 940 μs --.

COLUMN 5:
Line 14, “a.” should read -- a --; and
Line 27, “an” should read -- a --.

COLUMN 6:
Line 4, “forth” should read -- fourth --.

COLUMN 7:
Line 21, “numeral indicates” should read -- numerals indicate --;
Line 64, “relation of reciprocal.” should read -- reciprocal relation. --; and
Line 67, “is” should read -- are --.

COLUMN 9:
Line 30, “Therefor,” should read -- Therefore, --;
Line 44, “subfield” should read -- subfields --;
Line 52, “period” should read -- periods --; and
Line 53, “period.” should read -- periods. --.

COLUMN 10:
Line 36, “number” should read -- numbers --; and
Line 55, “lines;” should read -- lines, --.

UNITED STATES PATENT AND TRADEMARK OFFICE

CERTIFICATE OF CORRECTION

PATENT NO. : 6,992,663 B2
APPLICATION NO. : 10/247626
DATED : January 31, 2006
INVENTOR(S) : Hiroyuki Nakamura et al.

It is certified that error appears in the above-identified patent and that said Letters Patent is hereby corrected as shown below:

COLUMN 12:
Line 8, “lines;” should read -- lines, --; and
Line 15, “series,” should read -- series, and --.

Signed and Sealed this

Ninth Day of January, 2007

JON W. DUDAS
*Director of the United States Patent and Trademark Office*